US008544540B2

(12) United States Patent
Khomynets

(10) Patent No.: US 8,544,540 B2
(45) Date of Patent: Oct. 1, 2013

(54) WELL JET DEVICE FOR LOGGING AND DEVELOPING HORIZONTAL WELLS WITH ABNORMALLY LOW FORMATION PRESSURE

(76) Inventor: Zinoviy Dmitrievich Khomynets, Moscow (RU)

( * ) Notice: Subject to any disclaimer, the term of this patent is extended or adjusted under 35 U.S.C. 154(b) by 365 days.

(21) Appl. No.: 12/996,106

(22) PCT Filed: Jul. 1, 2009

(86) PCT No.: PCT/RU2009/000324

§ 371 (c)(1),
(2), (4) Date: Dec. 3, 2010

(87) PCT Pub. No.: WO2009/157812

PCT Pub. Date: Dec. 30, 2009

(65) Prior Publication Data

US 2011/0073301 A1 Mar. 31, 2011

(30) Foreign Application Priority Data

Jun. 25, 2008 (RU) ..... 2008125401

(51) Int. Cl.
*E21B 43/16* (2006.01)

(52) U.S. Cl.
USPC ..... 166/106

(58) Field of Classification Search
USPC ..... 166/250.15, 67, 106, 250.01, 254.2, 166/385; 417/172, 167; 73/152.01, 152.02, 73/152.03, 152.36
See application file for complete search history.

(56) References Cited

U.S. PATENT DOCUMENTS 5,372,190 A * 12/1994 Coleman ..... 166/68
6,325,152 B1 12/2001 Kelley et al.
6,877,571 B2 * 4/2005 Hughes et al. ..... 175/57

FOREIGN PATENT DOCUMENTS

RU 2324079 C1 5/2008
RU 2324843 C1 5/2008
WO 2005/059369 A1 6/2005

* cited by examiner

*Primary Examiner* — David Andrews
*Assistant Examiner* — Marwan Bashir
(74) *Attorney, Agent, or Firm* — patenttm.us

(57) ABSTRACT

Well pump units for studying, repairing and developing of wells. The proposed well jet system comprises a logging instrument, a movable sealing unit, and a jet pump arranged in a flow string. The latter enables to create a series of different drawdown values in a well under-packer area, and thus to register parameters of the well and a medium pumped out of the well and to easily register a formation pressure restoration curve for the well under-packer area. When testing the formation, a pumping mode may be adjusted by changing pressure of an active working medium supplied to a jet pump nozzle. The provision of a channel for supplying the pumped out medium with a check valve helps avoiding a spontaneous flow of the working medium into the under-packer area. The system reveals increased operational reliability and productivity during the treatment of a productive formation and well testing.

1 Claim, 1 Drawing Sheet

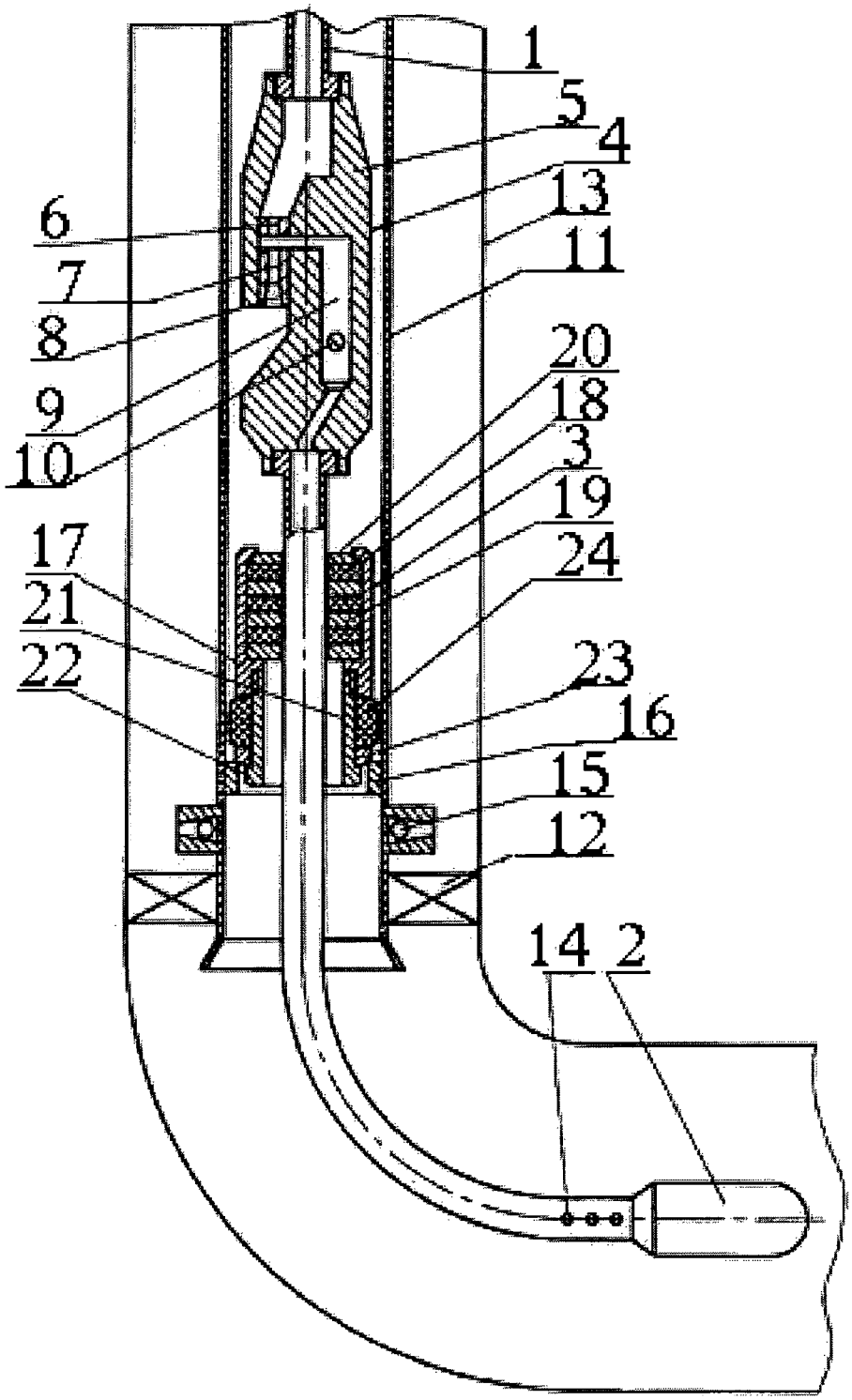
1
5
4
13
11
6
7
8
9
10
20
18
3
19
24
17
21
22
23
16
15
12
14
2

WELL JET DEVICE FOR LOGGING AND DEVELOPING HORIZONTAL WELLS WITH ABNORMALLY LOW FORMATION PRESSURE

BACKGROUND OF THE INVENTION

1. Field of the Invention

This invention relates to pump engineering, in particular to well pump units for studying, repairing, testing and developing wells.

2. Description of the Related Art

A well jet device is known, which comprises, all being installed on a pipe string upwards: a packer provided with a central channel, and a jet pump which body is provided with an active nozzle and a mixing chamber with a diffuser as well as a channel for supplying a working medium and a channel for supplying a medium pumped out of a well, a pass being made in the jet pump body with the possibility of installing replaceable functional inserts and a sealing assembly (see: RU Patent No. 2176336, PO4P 5/02, 27.11.2001).

The known well jet device enables to treat a formation below the jet pump level in a well, including treatment with creation a pressure differential between pressures above and below the sealing unit. However, the capacity of the known well jet device is not used in full, since a big time is required for replacing inserts, and such time is often greater than a time of reaction between an acid solution and minerals of a producing formation.

The closest to this invention as to its technical essence and achieved result is a well jet device for logging horizontal wells, which comprises, all being arranged on a flexible smooth pipe upwards, a packer provided with a central channel, and a jet pump which body is provided with a nozzle and a mixing chamber with a diffuser, the diffuser outlet being connected to the inner cavity of the flexible smooth pipe via a channel for removing a medium mixture, as made in the jet pump body, the inlet of the jet pump nozzle being connected to the annular space around the flexible smooth pipe, and the channel for supplying a medium pumped out of a well being connected to the inner cavity of the flexible smooth pipe via an upper and a lower windows made in the jet pump body, and a check valve being arranged in the channel for supplying a pumped-out medium on its inlet at the lower window, a multiple-measurement instrument being arranged on the lower end of the flexible smooth pipe, a sealing element shaped as a profiled ring being movably arranged on the flexible smooth pipe below the packer, and openings, which communicate the inner cavity of the flexible smooth pipe with the annular space below the packer, being made in the wall of the flexible smooth pipe above the multiple-measurement instrument (see: RU Patent No. 2324079, PO4P 5/54, 10.05.2008).

This well jet device enables to study horizontal wells and treat producing formations in them. However, an installed switch for working medium flows narrows the capacity of the device in studying productivity of a formation during treating it.

BRIEF SUMMARY OF THE INVENTION

The objective of this invention is to improve quality of works aimed at increasing well production rates by expanding the device functionality, in particular, to perform operations on treatment of a producing formation without rearranging a flow string.

The technical effect achieved after implementing of the invention is improvements in reliability of operation and productivity of a well jet device in treating a producing formation and testing a well.

The said objective and the technical effect are achieved due to the fact that the inventive well jet device comprises, all being arranged on a flexible smooth pipe upwards, a multiple-measurement instrument embracing the flexible pipe, a sealing element arranged movably, and a jet pump, which body is provided with a nozzle and a mixing chamber with a diffuser, the diffuser outlet being connected to the annular space around the flexible smooth pipe, the inlet of the jet pump nozzle being connected to the inner cavity of the flexible smooth pipe, a check valve being arranged in the channel for supplying a pumped-out medium on its inlet. The flexible smooth pipe is arranged with the possibility of moving axially in a flow string provided with a packer for the purpose of sealing space between the flow string and a casing string. Openings are made in the wall of the flexible smooth pipe above the multiple-measurement instrument, and the inner cavity of the flexible smooth pipe is connected via the said openings to the under-packer well space. Circulation valves are arranged in the wall of the flow string above the packer, and a supporting ring, which is provided with a pass opening intended for arranging a sealing element, is arranged above the circulation valves, the said sealing element is made as a cylindrical housing arranged in the upper part and filled with a set of elastic gaskets embracing the flexible smooth pipe, the said gaskets being provided with thrust washers arranged between the gaskets and with a thrust pressure element. A bearing sleeve is fixed in the body lower part and has a thrust flange in its lower end and a movable thrust ring arranged above the flange on the sleeve. An elastic sealing collar is arranged between the said ring and the lower part of the cylindrical housing.

An analysis of operation of the well jet device shows that reliability and efficiency of the device operation may be improved through optimizing the device structure and, due to this, it is possible to achieve more clean near-well area, shorten time required for carrying out such works and expand the functionality of the device when testing and developing wells without rearranging equipment used in the device.

It is found that hydrodynamic action on the near-well area enables to use the well jet device most efficiently when developing and repairing oil and gas wells during works on intensifying oil inflow from a producing formation. The device enables to clean a producing formation from mud particles and reaction products after treating a formation with chemical reagents, make control measurements both before and during treatment, which, in its turn, enables to assess technical condition and productivity of a well as well as properties of a medium pumped out of a well. While proceeding from an inflow studies, it becomes possible to assess treatment quality of the producing formation near-well area. Providing the device with a multiple-measurement instrument arranged on, and embracing, the flexible smooth pipe, a sealing element arranged movably, and a jet pump which body is provided with a nozzle and a mixing chamber with a diffuser, as well as arranging the flexible smooth pipe with the possibility of moving axially in a flow string provided with a packer for the purpose of sealing a space between the flow string and the casing string and arranging circulation valves in the wall of the flow string above the packer enable to treat a producing formation by pumping chemical reagents and/or hydrofracturing fluid into a formation through the flow string.

Arranging a supporting ring with a pass opening intended for installing a sealing element in the flow string and making the sealing element as a set of elastic gaskets with thrust washers therebetween, which embrace the flexible smooth pipe, and a thrust pressure element on their top as well as fixing a supporting sleeve provided with a thrust flange in its lower end and a movable thrust ring arranged on the sleeve above the flange, provided that an elastic sealing collar is arranged between the said ring and the upper part of the cylindrical housing, enables to install a jet pump in the flow string quickly and automatically separate the well spaces below and above the jet pump.

A jet pump arranged in a flow string enables to create by using it a series of different drawdown values in a well under-packer area and to register pressures, temperatures and other parameters of the well and a medium pumped out of that well, study and test a well, and register a formation pressure restoration curve for the well under-packer area without using a special functional insert. At the same time, it provides for the possibility of controlling the pumping rate of an active working medium. When testing a formation, the pumping mode may be adjusted by changing pressure of an active working medium supplied to the jet pump nozzle. At the same time, the provision of the channel for supplying a medium pumped out of a well with a check valve enables to avoid a spontaneous flow of a working medium into the under-packer area when the jet pump is or is not operated.

The arrangement of the logging instrument on the flexible smooth pipe with the possibility for the latter of moving axially in a well without using a packer (a sealing element, which is put on the flexible smooth pipe, is used instead of a packer) enables to speed up and, consequently, simplify the process of moving a multiple-measurement instrument in a well, and, hence, simplify the procedure of testing and preparing a well for operation. Moreover, the arrangement of a multiple-measurement instrument on the flexible smooth pipe enables, due to the latter's elastic properties, to position the multiple-measurement instrument in an area of producing formations in horizontal sections of wells, which enables to get more reliable reactive information on condition of producing formations, inflow of a formation fluid and properties of the latter.

In the result, works on studying and developing wells are intensified, which enables to study and test wells with good quality after drilling and during well-workover operations as well as prepare a well for operation after conducting extensive studies and tests in various modes and, due to all this, improve the device operation reliability.

BRIEF DESCRIPTION OF THE SEVERAL VIEWS OF THE DRAWINGS

FIGURE shows a longitudinal section of the proposed well jet device for logging horizontal wells.

DETAILED DESCRIPTION OF THE INVENTION

The proposed well jet device comprises, all being arranged on a flexible smooth pipe 1 upwards, a multiple-measurement instrument 2 embracing the flexible pipe 1, a sealing element 3 arranged movably and a jet pump 4 which body 5 is provided with a nozzle 6 and a mixing chamber 7 with a diffuser 8. The outlet of the diffuser 8 is connected to the annular space around the flexible smooth pipe 1, and the nozzle 6 of the jet pump 4 is connected, on the side of its inlet, to the inner cavity of the flexible smooth pipe 1. A check valve 10 is arranged in the channel 9 for supplying a medium pumped out of a well, the channel being made in the body 5 of the jet pump 4, and is arranged in the inlet portion of the channel. The flexible pipe 1 is arranged with the possibility of moving axially in a flow string 11 provided with a packer 12 for the purpose of sealing the space between the flow string 11 and a casing string 13. Openings 14 are made in the wall of the flexible smooth pipe 1 above the multiple-measurement instrument 2, which are used for connecting the inner cavity of the flexible smooth pipe 1 to the under-packer area of the well. Circulation valves 15 are arranged in the wall of the flow string 11 above the packer 12, and a supporting ring 16 is arranged above the circulation valves 15 and is provided with a pass opening used for arranging the sealing element 3, the latter being made as a cylindrical housing 17 filled in its upper portion with a set of elastic gaskets 18 with thrust washers 19 arranged therebetween, the gaskets embracing the flexible smooth pipe 1, and a thrust pressure element 20 is arranged on the top of the set. A supporting sleeve 21 is fixed in the lower portion of the cylindrical housing 17 and is provided in its lower end with a thrust flange 22 above which and on the sleeve 21 a movable thrust ring 23 is installed. A sealing collar 24 is arranged between the movable thrust ring 23 and the lower portion of the cylindrical housing 17.

The packer 12 and the circulation valves 15 are lowered on the flow string 11 to a vertical section of a well.

Then, the packer is released, and an acid solution and/or hydrofracturing fluid are pumped via the flow string 11 to a producing formation. After this, the multiple-measurement instrument 2, the sealing element 3 and the jet pump 4 are lowered on the flexible smooth pipe 1 to a horizontal section of the well. The sealing element 3 is arranged on the supporting ring 16, and the multiple-measurement instrument 2 is arranged in the area of the producing formation (not shown) of the horizontal well, while registering the well geophysical parameters along the well bore, such as pressure and temperature in the under-packer area, including the area of the producing formation. Then, a pressurized working medium is supplied via the flexible smooth pipe 1 to the nozzle 6 of the jet pump 4, the well is drained, and reaction products and/or the hydrofracturing fluid are removed from the producing formation, while regularly measuring well rates at different values of pressure drawdown to the producing formation and continuously recording bottomhole pressure and composition of a pumped out liquid medium with the use of the multiple-measurement instrument 2. Due to a pressure created in the annular space around the flexible smooth pipe 1 in the result of supplying a medium from the jet pump 4 to the annular space, the thrust pressure element 20 exerts pressure on the elastic gaskets 18, thus expanding them and sealing an annular gap around the flexible smooth pipe 1. Simultaneously with it, under the medium pressure in the annular space around the flexible smooth pipe 1, the cylindrical housing 17 moves downward and expands the sealing collar 24, thus sealing the annular gap relative to the flow string 11. Then, without stopping drainage from the well, the multiple-measurement 2 is raised to the vertical section of the well, thus registering the geophysical parameters in the under-packer area, including the area of the producing formation. After this the jet pump is stopped, and the inner cavity of the flexible smooth pipe 1 above the jet pump 4 together with the annular space above the sealing element 3 is separated from the inner cavity of the flexible smooth pipe 1 under the jet pump 4 together with the under-packer area, while keeping a low bottomhole pressure under the packer 12, at which pressure a curve of formation pressure recovery is recorded with the use of the multiple-measurement instrument 2. Then a gas is supplied via the flexible smooth pipe 1, thus expelling the liquid medium from it and from the annular space around it, after this, the flexible smooth pipe 1 with the jet pump 4, the sealing element 3 and the multiple-measurement instrument are raised to the surface from the well. Then a decision on either to continue studying of the well or to put it into the operation mode.

INDUSTRIAL APPLICABILITY

This invention may be used in the oil and gas industry for developing horizontal wells after their drilling or underground repairs for the purposes of intensifying flow rates of hydrocarbons and increasing intake capacity of injection wells.

What is claimed is:

1. A well jet system, comprising, arranged on a flexible smooth pipe upwards, a multiple-measurement instrument embracing the flexible smooth pipe, a movable sealing element and a jet pump having a body, said body provided with a nozzle and a mixing chamber with a diffuser;

wherein an outlet of the diffuser is connected to an annular space around the flexible smooth pipe, and the nozzle is connected to an inner cavity of the flexible smooth pipe on the side of an inlet to the nozzle;

wherein the body of the jet pump comprising a channel for supplying a medium pumped out of a well with a check valve arranged in an inlet portion of said channel for supplying a medium pumped out of a well;

wherein the flexible smooth pipe is made movable axially in a flow string, the flow string provided with a packer sealing a space between the flow string and a casing string;

wherein a wall of the flexible smooth pipe comprises openings made above the multiple-measurement instrument, said openings being used for connecting the inner cavity of the flexible smooth pipe with an under-packer area of a well;

wherein circulation valves are arranged in a wall of the flow string above the packer, and a supporting ring is arranged above the circulation valves, said supporting ring provided with a pass opening for arranging the sealing element, wherein the sealing element being made as a cylindrical housing filled in its upper portion with a set of elastic gaskets with thrust washers arranged between the elastic gaskets, said elastic gaskets embracing the flexible smooth pipe, and a thrust pressure element is arranged on a top of the set of elastic gaskets;

wherein a supporting sleeve is fixed in a lower portion of the cylindrical housing, said supporting sleeve provided with a thrust flange arranged at a lower end of the supporting sleeve and with a movable thrust ring arranged above the thrust flange;

wherein a sealing collar is arranged between the movable thrust ring and the upper portion of the cylindrical housing.

* * * * *